United States Patent [19]

Ohishi et al.

[11] Patent Number: 4,496,111

[45] Date of Patent: Jan. 29, 1985

[54] APPARATUS FOR AND METHOD OF REMOVING WOUND PAPER FROM A CORE ROD

[75] Inventors: Kishiro Ohishi; Choji Kato, both of Niigata, Japan

[73] Assignee: Hokuetsu Kamiseisen Kabushikikaisha, Niigata, Japan

[21] Appl. No.: 467,091

[22] Filed: Feb. 16, 1983

[51] Int. Cl.[3] ..... B65H 75/02

[52] U.S. Cl. ..... 242/55; 366/185; 366/220

[58] Field of Search ..... 242/55 R, 54 R; 51/163.1, 163.2, 164.1, 164.2; 366/185, 220, 54

[56] References Cited

U.S. PATENT DOCUMENTS

| | | | |
|---|---|---|---|
| 1,702,759 | 2/1929 | Barber | 51/164.1 |
| 2,186,448 | 1/1940 | Bunnell | 366/185 |
| 2,353,637 | 7/1944 | Barnes | 366/185 |
| 2,370,792 | 3/1945 | Hoffman | 51/164.1 |
| 2,613,036 | 10/1952 | Robinson | 51/164.1 |
| 2,883,118 | 4/1959 | Taylor | 51/164.1 |
| 3,291,304 | 12/1966 | Fuchs | 366/220 |

*Primary Examiner*—Leonard D. Christian
*Attorney, Agent, or Firm*—Keiichi Nishimura

[57] ABSTRACT

An apparatus for using centrifugal force to remove left-over rolls of paper from the core rods around which they are wound. The rods are placed inside a cylindrical container rotating around its axis of symmetry which is maintained at an angle with the vertical direction. The speed of rotation can be varied in accordance with the quality of the paper.

4 Claims, 3 Drawing Figures

APPARATUS FOR AND METHOD OF REMOVING WOUND PAPER FROM A CORE ROD

DESCRIPTION

BACKGROUND OF THE INVENTION

This invention relates to an apparatus for removing rolls of left-over paper from the core rods around which they are wound. This invention relates in particular to such an apparatus where the rods are used either in the manufacturing process of continuous sheets of paper or for a reel of paper for use in a rotary printing press.

When paper from several reels is piled during a paper manufacturing process and cut into sheets by a cutter, there is generally left-over paper wound around each core rod at the end of the cutting process because the webs are not uniform in length. Before these core rods can be used again, therefore, it is necessary to remove such left-over paper from them. Since the paper is tightly wound around the core rod, however, it is difficult to remove the paper even by a tool having a sharp edge. The work of removing the paper is currently carried out by hand; it is both time-consuming and extremely labor-inefficient.

SUMMARY OF THE INVENTION

It is an object of the present invention to provide an apparatus for speedily and automatically removing wound paper from a core rod.

It is another object of the present invention to provide an apparatus for the above purpose which, equipped with a cylindrical container rotating around an inclined axis, can control the motion of the core rod and paper so as to create a safe working system.

It is a further object of the present invention to provide an apparatus for the above object which allows the rotational velocity of the container to be easily adjusted by means of a frequency changer or the like so that a rate of rotation best suited to the quality of the paper can be selected.

It is a still further object of this invention to provide an apparatus as described above wherein the diameter of the container can be increased when the amount of paper left on the rod is large or when the processing time must be reduced.

The above and other objects of the present invention can be achieved, as will become apparent from the following description and the accompanying drawings, by installing a cylindrical container with an open end and a closed end in such a way that it will rotate freely around its axis, its open end remaining at a higher position than its closed end and the axis of rotation being maintained at an appropriate angle with the vertical direction. The open end is supported by a plurality of rollers and both these rollers and the driving means for the container are made parts of a housing structure.

DETAILED DESCRIPTION OF THE INVENTION

Figure 1:
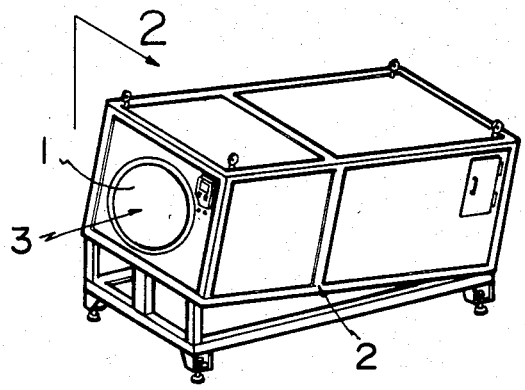
FIG. 1 is a diagonal over-all view of an apparatus for removing wound paper from core rods according to the present invention.
Figure 2:
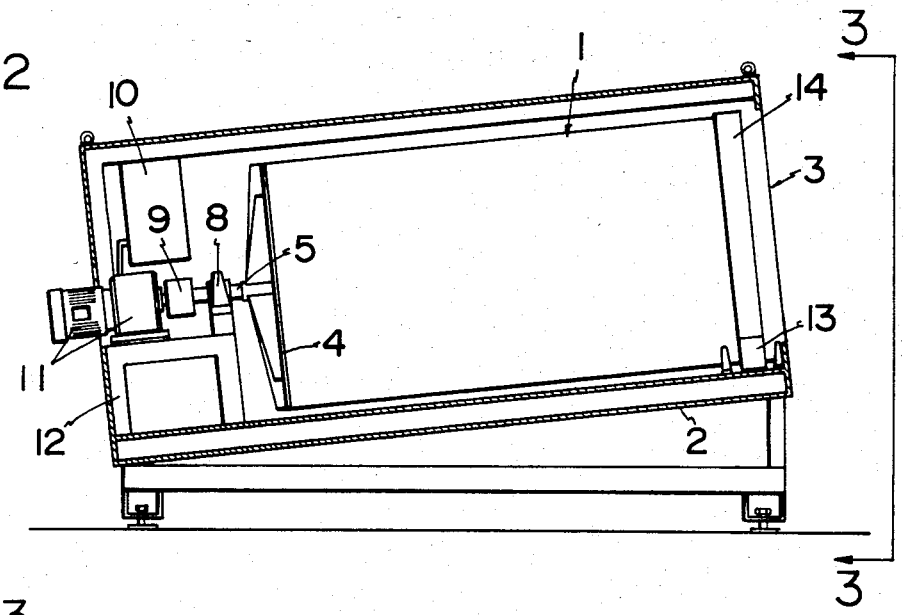
FIG. 2 is a vertical cross-sectional view of the apparatus of FIG. 1.
Figure 3:
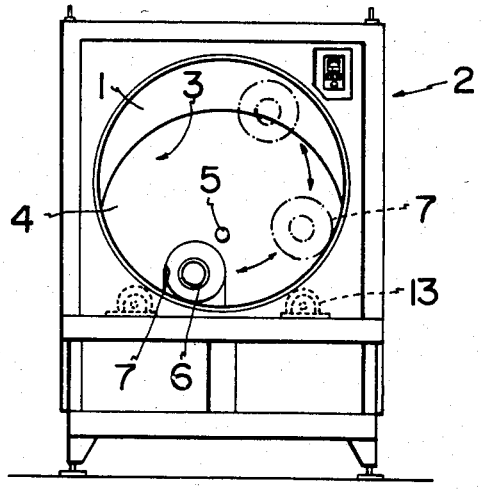
FIG. 3 is a side view of the apparatus of FIG. 1.

Referring now to the accompanying drawings in which like components are designated by like numerals, a cylindrical rotary container 1 made, for example, of iron is installed diagonally inside a rectangular housing 2 so as to be able to rotate freely around its axis of symmetry. One end 3 of this container 1 is open so that core rods 6 with left-over paper 7 wound around them can be thrown in and maintained inside substantially in the same direction as said axis of symmetry. The other end of the container 1 is closed with a base plate 4; a rotary axis 5 is affixed to the base plate 4 at its center and is supported by a pair of bearings 8 on the supporting member 12 affixed to the housing 2. Rotary axis 5 is connected to a geared motor 11 through a coupler 9. The rotational motion of the geared motor 11 is controlled by a frequency changer 10, or the rate of rotation of the motor 11 can be varied easily by means of a control box contained inside the changer 10. Not only is the periphery of the open end 2 of the container 1 supported by a plurality of supporting rollers 13 affixed to the housing 2 but a steel band 14 is affixed around said periphery so that the container 1 can rotate smoothly around the axis 5. The rectangular housing 2 supports the container 1 in such a way that the latter's axis of rotational symmetry will be maintained at a certain predetermined angle with the vertical direction, with the open end 2 kept higher than the closed end. Adjustments regarding this angle may be accomplished by making the legs of the housing 2 on the open-end side appropriately longer than those on the closed-end side. This is for the purpose of preventing the core rods 6 and paper 7 from flying out during the operation of the apparatus.

In operation, the rotational velocity of the container 1 is adjusted by the control box of the frequency changer 10, depending on the characteristics of the paper such as its thickness and hardness. When core rods 6 with left-over paper 7 wound around them are placed inside the container 1 and the motor 11 is switched on to rotate the container 1, the rods 6 begin to move up and down repeatedly inside the container 1 along the direction of its axis while the left-over rolls of paper begin to unwind along the internal surface of the container 1 by centrifugal force. When the paper 7 is completely unwound, the rods 6 and paper 7 are all taken out of the container 1. When the motor 11 is is switched off, however, the container 1 may not come to a complete stop immediately because of its moment of inertia. If it is desirable to be able to stop the container motion instantly, an electrical control mechanism may be added to the apparatus.

Although the present invention has been described above in terms of only a particular embodiment, this description is to be considered as illustrative rather than as limiting, and this invention is accordingly to be broadly construed. For example, the container 1 may be of any reasonable shape and size such as diameter. The angle at which its axis is maintained during operation may be made variable; it can be varied, for example, by means of a jack and such a device may be made a part of the apparatus. The rollers 13 may be either welded or bolted to the housing 2. The apparatus may also include several containers of different sizes so that one with appropriate size can be mounted, depending on the requirement of the situation. The scope of the invention is defined only by the following claims.

What is claimed is:

1. A method of removing wound paper from a core rod, said method comprising the steps of rotating a cylindrical container around its axis and placing said core rod inside said container in the direction of said axis, said container being adapted to maintain said rod in the direction of said axis.

2. The method of claim 1 wherein said rotating step is effected with said axis maintained at an angle with the vertical direction.

3. The method of claim 1 wherein said rotating step is effected by a means which is capable of varying the speed of rotation of said container.

4. The method of claim 2 wherein said axis is maintained at an angle by rollers provided for supporting said container.

* * * * *